United States Patent [19]

Yoshida et al.

[11] Patent Number: 4,635,211

[45] Date of Patent: Jan. 6, 1987

[54] SPEECH SYNTHESIZER INTEGRATED CIRCUIT

[75] Inventors: Hideo Yoshida, Kashihara; Hisao Kunita, Yamatokoriyama, both of Japan

[73] Assignee: Sharp Kabushiki Kaisha, Osaka, Japan

[21] Appl. No.: 434,500

[22] Filed: Oct. 15, 1982

[30] Foreign Application Priority Data

| | | | |
|---|---|---|---|
| Oct. 21, 1981 | [JP] | Japan | 56-169337 |
| Oct. 21, 1981 | [JP] | Japan | 56-169338 |
| Oct. 21, 1981 | [JP] | Japan | 56-169339 |
| Oct. 30, 1981 | [JP] | Japan | 56-175103 |

[51] Int. Cl.[4] ..... G10L 5/00

[52] U.S. Cl. ..... 364/513.5; 381/51

[58] Field of Search ..... 381/51–53; 364/513.5

[56] References Cited

U.S. PATENT DOCUMENTS

| | | | |
|---|---|---|---|
| 4,153,933 | 5/1979 | Blume et al. | 364/200 |
| 4,369,334 | 1/1983 | Nakatani et al. . | |
| 4,387,269 | 6/1983 | Hashimoto et al. | 381/51 |
| 4,421,416 | 12/1983 | Hashimoto et al. . | |
| 4,423,290 | 12/1983 | Yoshida et al. | 381/51 |
| 4,429,182 | 1/1984 | Masuzawa et al. | 381/51 |
| 4,429,367 | 1/1984 | Ikeda | 381/51 |
| 4,441,399 | 4/1984 | Wiggins et al. | 381/51 |

*Primary Examiner*—E. S. Matt Kemeny

*Attorney, Agent, or Firm*—Birch, Stewart, Kolasch & Birch

[57] ABSTRACT

Disclosed is a speech synthesizer integrated circuit as a preferred embodiment of the present invention, which is characterized in that;

Using one chip LSI, it implements the fundamental controls for the speech synthesizing operations, for example, and fundamental controls for the key input and display operations (corresponding to the functions usually performed by any of the conventional microprocessors). The preferred embodiment of the present invention has made it possible to realize an extremely useful and versatile speech synthesizer integrated circuit by externally connecting a memory that stores the controlled programs and sound data available for synthesizing the intended speech. By allocating the same addresses to the internal and external memory storage areas, programs can be located at identical memory addresses, thereby increasing system efficiency.

19 Claims, 7 Drawing Figures

SPEECH SYNTHESIZER INTEGRATED CIRCUIT

BACKGROUND OF THE INVENTION

The present invention relates to a speech synthesizer integrated circuit, and more particularly to a speech synthesizer apparatus integrated circuit (hereinafter referred to as speech synthesizer LSI), that is used in conjunction with key input and display apparatuses. This invention is extremely useful and versatile for speech generating applications.

A variety of techniques have recently been developed using digital control technologies in order to synthesize speech and other complex waveforms.

Such a speech synthesizer apparatus can effectively be applied to a wide variety of uses, for example, electronic calculators that calculate and inform the operators of the calculated results, clocks that inform users of the time by generating speech, or to other apparatuses that can explain their operational methods to users.

It is anticipated that such a speech synthsizer apparatus can be extensively applied to broader uses from now on.

Conventional speech synthesizer systems are composed of microprocessors and a speech synthesizer LSIs, where the microprocessors instruct the speech synthesizer LSIs so that the intended speech can be generated in response to the instructions given. In other words, an algorithm related to a sequence for controlling the speech synthesizing operation is stored in the microprocessor, whereas the basic sound data used to synthesize speech is stored in the speech synthesizer LSI.

When considering the total scope of, for example, a speech generating electronic calculator and clock the synthesizer speech output control circuit usually occupies a scope considerably larger in size than the function control circuit.

With a speech generating electronic calculator having a construction such as mentioned above, the microprocessor controls the key input, arithmetic and display operations that are characteristic of an electronic calculator, enabling the calculator to output a designated speech to the speech synthesizer LSI upon delivery of an instruction and/or data from the microprocessor.

Such a speech synthesizer system cannot control the speech synthesizing, key input and display operations using the one-chip speech synthesizer LSI. In addition, such a speech synthesizer LSI memory cannot permanently store any sound data before synthesizing speech for application to a conventional speech generating apparatus. Thus, the above described speech synthesizer system remains ineffective due to incomplete utility as a whole.

The primary objective of the present invention is to properly compensate for such incomplete utility prevailing in the conventional speech synthesizer systems as mentioned above. More particularly, the present invention provides a variety of fundamental control functions such as the key input, display, arithmetic and speech synthesizer controls. In other words, the speech synthesizer integrated circuit embodied in the present invention incorporates the microprocessor control functions. The one-chip LSI and an externally connected memory control the fundamental functions of the synthesizer, while the externally connected memory stores arithmetic calculation procedures and sound data that synthesizes speech. The present invention provides a highly versatile speech synthesizer integrated circuit requiring fewer parts than any other conventional speech synthesizing system.

There are several methods available for synthesizing speech. However, the present invention is particularly effective in, for example, the waveform synthesizing method embodied in the present invention because it eliminates the sound generating circuit conventionally needed for either the "PARCOL" or LPC (line printer control) system or a hard circuit contruction such as a digital filter.

BRIEF DESCRIPTION OF THE INVENTION

DETAILED DESCRIPTION OF THE INVENTION

Figure 1:
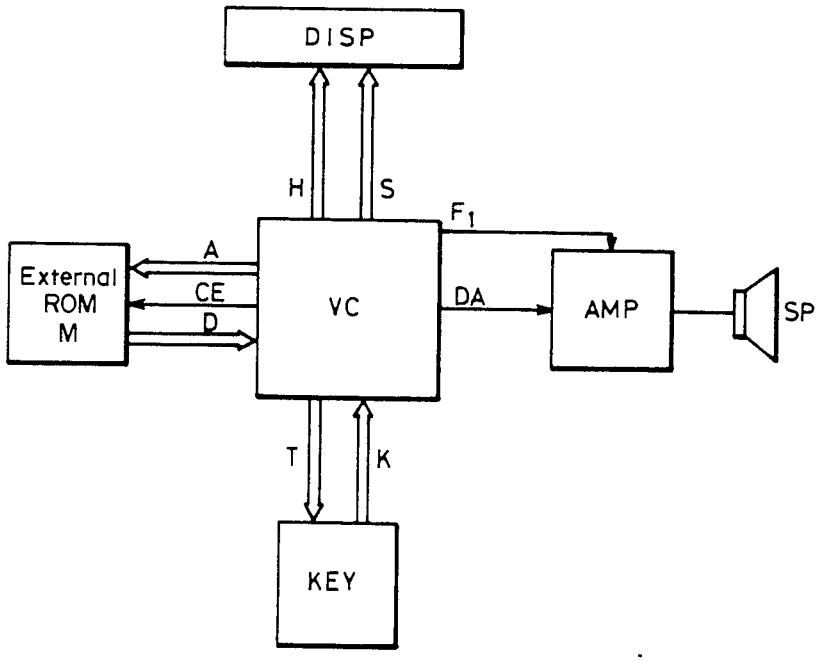
FIG. 1 shows a simplified block diagram of a speech synthesizer calculator incorporating a preferred embodiment of the present invention.

FIG. 1 shows a simplified block diagram of a preferred embodiment of the present invention incorporated in a speech synthesizer calculator. In FIG. 1, VC represents a controller that controls the speech synthesizer system. This controller is provided with a variety of external terminals.

A represents the address bus. D represents the data bus. CE represents the chip enable signal line to which read-only memory ROM is externally connected. DA represents the audio signal output line which is connected to an audio amplifier AMP. A speaker SP is connected to the output of this AMP. F1 represents a port through which an AMP power control signal is sent to said AMP. T represents the strobe signal output line, while K represents the key return signal line which is connected to the key input unit KEY.

H represents the common signal line and S being the segment signa line connected to the liquid crystal display unit DISP.

The external read-only memory (ROM) M preliminarily stores sound data and main programs that define, for example, the functionality of an electronic calculator.

VC incorporates an internal ROM, read/write memory and the arithmetic control circuit. The speech synthesizing control program is preliminarily stored in VC's ROM. As a result of the construction mentioned above, the controller VC is extremely versatile in controlling the speech synthesizer apparatus. In other words, even if there are differences in the apparatuses, synthesized speech to be output, and/or in the specifications, the controller VC can be operated without modification, except for some changes to the external ROM's memory, the key top display, and the display segment construction.

Figure 2:
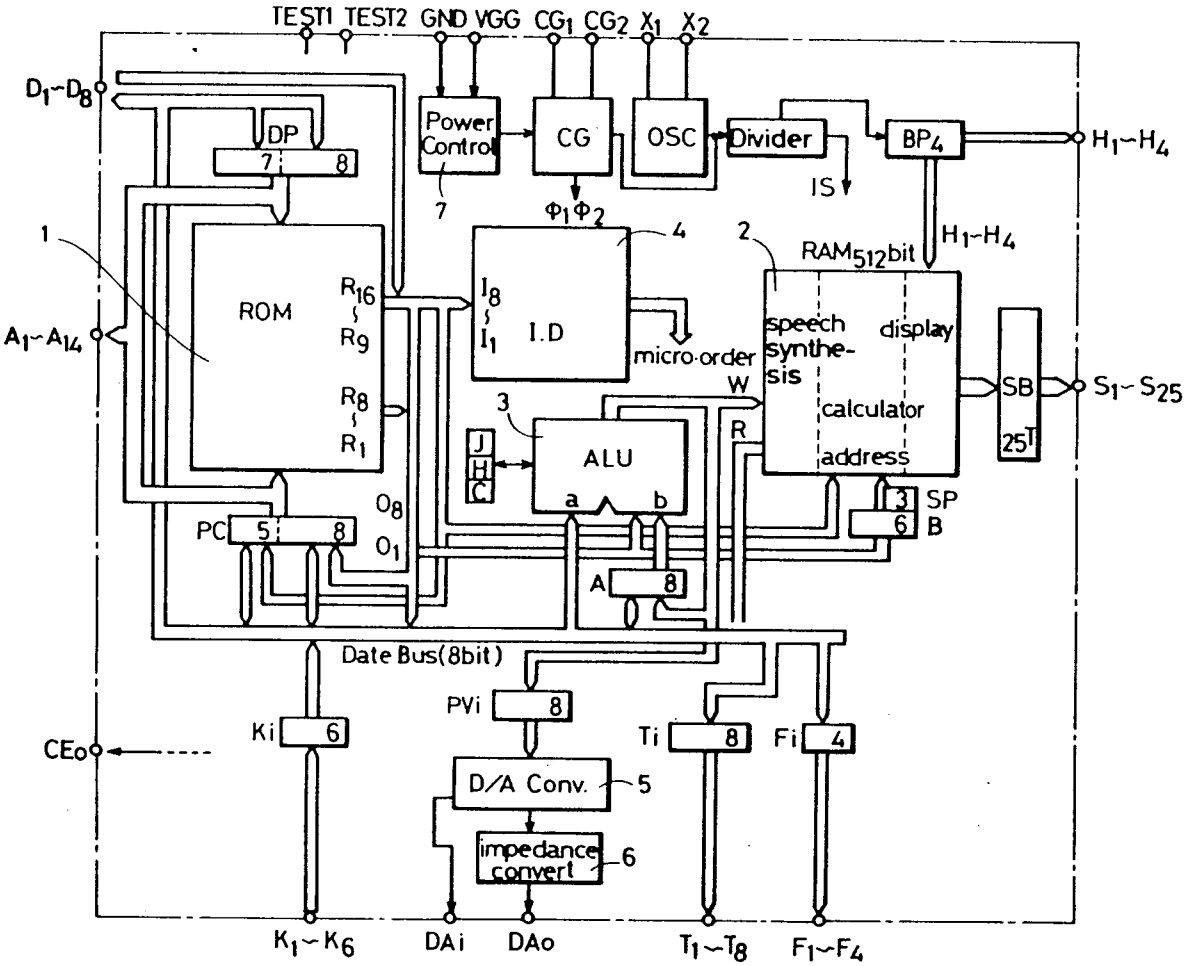
FIG. 2 shows a systematic diagram of the controller of the block diagram shown in FIG. 1.

FIG. 2 shows a systematic diagram of the controller VC. In FIG. 2, symbol 1 represents the ROM that preliminarily stores a certain algorithm (process program) which controls the speech synthesizing operation, where the ROM has a maximum 16 bit/52 step memory capacity.

A1 through A14 represent address signal terminals through which the address signals are output to the external ROM. D1 through D8 represent data signal terminals that read a variety of data from the external ROM. PC represents the program counter. DP represents the data pointer DP. More particularly, PC is a counter indicating addresses that control the speech synthesizer of the built-in ROM as well as the addresses of the external ROM's main programs. DP is the pointer indicating the position (address) of the speech data stored by the external ROM.

Symbol 2 represents read/write memory (RAM), having a memory capacity of 8 bits$\times$64=512 bits, that is provided with an area used for controlling the speech synthesizer, an area used for the arithmetic operation performed by, for example, an electronic calculator, and a third area used for display operation.

Each bit in the display area corresponds to a segment of the liquid crystal display device. The display pattern is written in the display area for display.

Symbol B represents the address register of the RAM. A certain area of the RAM can be used as the stack for the sub-routines. Symbol SP is the stack pointer showing the stack position.

Symbol 3 represents the arithmetic and logical unit ALU that performs arithmetic and logical operations on data fed from the internal data bus, the built-in ROM, accumulator A, and other output signals.

Symbol J represents the identification flip-flop. H represents the carry (half-carry) flip-flop derived from the 4th bit, while C represents the carry flip-flop.

Symbol 4 represents the instruction decoder that decodes the operational codes of the upper 8 bits being output from the built-in ROM. This decoder outputs a micro-order signal.

Symbol 7 represents the power controller that controls ON/OFF operations of the oscillatory clock generator CG and system clock generator as well as of the display power source. System clock signals 01 and 02 are outputted during operation in order to activate the entire system. The system clock pulse is deactivated during the display mode, with only the display control remaining operative.

This LSI consists of C-MOS in order to minimize the power consumption when stopping the system clock generation when the display mode is entered. VGG is the negative power terminal of this LSI, while G1 and G2 are respectively the terminals to which either resistor or ceramic filter is connected in order to oscillate the built-in clock generator.

The clock generator oscillates 131 KHz of the frequency. OSC is the oscillator that provides the clock function, while the oscillated waveform is divided by a divider. X1 and X2 are respectively the terminals to which a crystal oscillator is connected.

The divider's input terminal is composed of a program logic array PLA, dividing an incoming signal either from the built-in clock generator or oscillator.

A second signal 1S is sent out from the last stage of the divider. BP represents the circuit that generates a common signal for the liquid crystal display device. H1 through H4 represent the common signal output terminals. BP also outputs address signals for the display area of RAM.

SB represents a buffer that generates a segment signal being sent to the liquid crystal display device. S1 through S25 represent the terminals connected to the segment terminals of the liquid crystal display device. Ki represents the 6 bits' input port, while K1 through K6 are connected to the key input unit to which the key return signal is fed.

Ti represents the 8 bits' output port, while the key input devices are connected to ports T1 through T8, from which key strobe signals are sent out.

F1 represents the 4 bits' output port. In the preferred embodiment of the present invention, the uppermost bit signal of the address signal is sent out from port F4 to the external ROM.

PVi represents the latch circuit latching the sound data of 8 bits sent out from the arithmetic/logical unit ALU.

Symbol 5 represents the D/A converter, while DAi represents a terminal that outputs the analog-converted sound signal.

Symbol 6 represents the impedance conversion circuit, With a feedback resistor provided between port DA0 and port DA1, a speaker can be driven by connecting a simple amplifier externally.

CEo represents a port that outputs a chip enable signal to the external ROM. Although not shown in the diagram, the chip enable signal generating circuit is operated by micro-orders.

Functional operations are described below.

Figure 3:
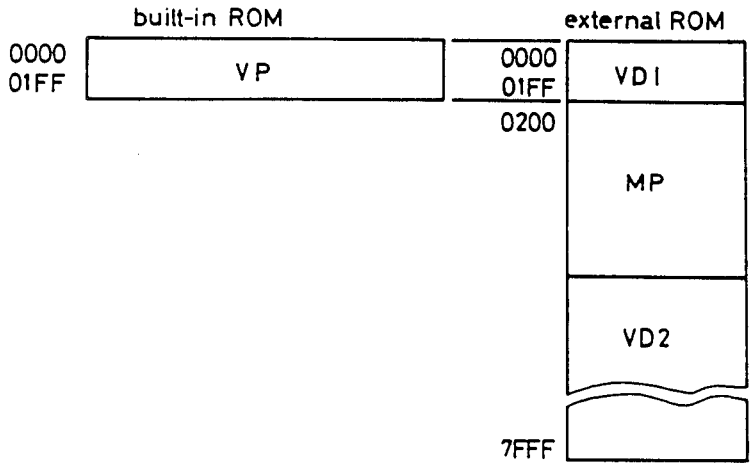
FIG. 3 shows the relationship of the addresses of the built-in ROM and external ROM.

FIG. 3 shows the relationship between the internal and external ROM addresses. The internal ROM has a 16 bit length, occupying an area ranging from address 0000 to 01FF. The external ROM has an 8 bit length, using an area ranging from address 0000 to 7FFF. VP represents the speech synthesizing control program. MP represents the main program which, for example, functions as an electronic calculator. VD1 and VD2 respectively represent the sound data memory areas. The program counter PC designates addresses within the programmable areas of VP and MP, respectively. The data pointer DP designates addresses in the entire area of the external ROM. In other words, when reading data from the external ROM, the data pointer is set to the address of the data that should be read before reading the data contents, fed from the external ROM.

When executing either the speech synthesizing control program instruction or main program instruction, the program counter PC value is counted up whenever executing the stepwise instructions designated by the program counter PC, so that the instructions can be sequentially executed.

Since each step of the speech synthesizing control program extends to 16 bits, even with a relatively slow system clock timing, speech can properly be synthesized despite the high speed arithmetic operation which must be performed.

The upper 8 bits make up the operation code, and as shown in FIG. 2, this operation code is fed to the instruction decoder, while the lower 8 bits being the operand, are fed to the internal data bus.

The instruction read out of the external ROM is then fed from the external data bus to the internal instruction decoder, while the data is fed to the internal data bus. Also, a RAM can be externally connected.

Figure 4:
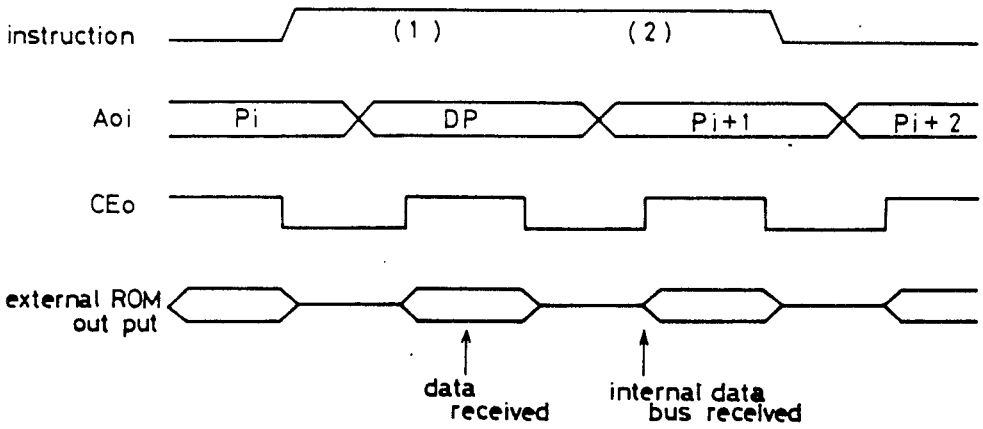
FIG. 4 shows a typical timing chart of the instructions that read the sound data from the external ROM.

As with the external ROM, both the address and data buses can commonly be made available by feeding both the chip enable and read/write signals from port F to RAM. FIG. 4 shows a typical timing chart for the instruction which reads the data (speech data) from the external ROM. This instruction requires two cycles. FIG. 4 shows the progress of this instruction in relation to the program counter PC contents Pi. During the first cycle of the instruction, a specific address within the data area is set in the data pointer DP so that relevant data can be taken and fed to the internal bus during the second cycle of the instruction given. Then, the program counter PC contents are counted up.

Figure 5:
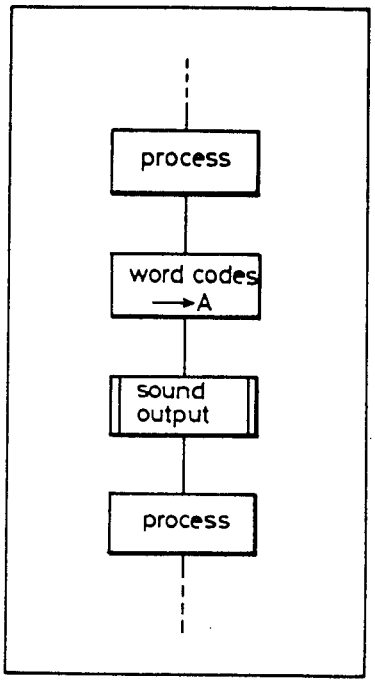
FIG. 5 shows a flow chart representing a sequence for the operational procedures of the entire speech synthesizer system.

FIG. 5 shows a flow chart illustrating the sequential procedures needed for the entire system.

First, the main program memorized by the external ROM is executed, then key identification, arithmetic operation and the display of the result from the arithmetic operation are sequentially executed.

In order to generate the intended speech, certain word codes corresponding to the pre-determined words are first loaded into an accumulator, then these word codes are jumped to (by means of the subroutine call) by the speech synthesizing control program. As a result, the intended speech can be generated audibly for the audience.

When a preferred embodiment of the present invention, such as described above, is implemented, a highly effective system can be realized. Execution of a program based on an instruction that requires a high speed airthmetic operation and a second program that does not require such a high speed operation can be accomplished by alignment of both programs in the identical address space positions.

More particularly, in a preferred embodiment of the present invention, an instruction requiring a high speed arithmetic operation for the speech synthesizing control (hereinafter referred to as the first instruction) and the other instruction that does not require such a high speed operation (hereinafter referred to as the second instruction) are stored in a memory (for example, ROM in the identical address space position when read-only memory is needed) that can either read or write both the first and second instructions based on the identical address designation control. Since the length of the first instruction word requiring a high speed arithmetic operation is designed to be longer than that of the second instruction word, any of the intended programs can be executed very effectively.

Figure 6:
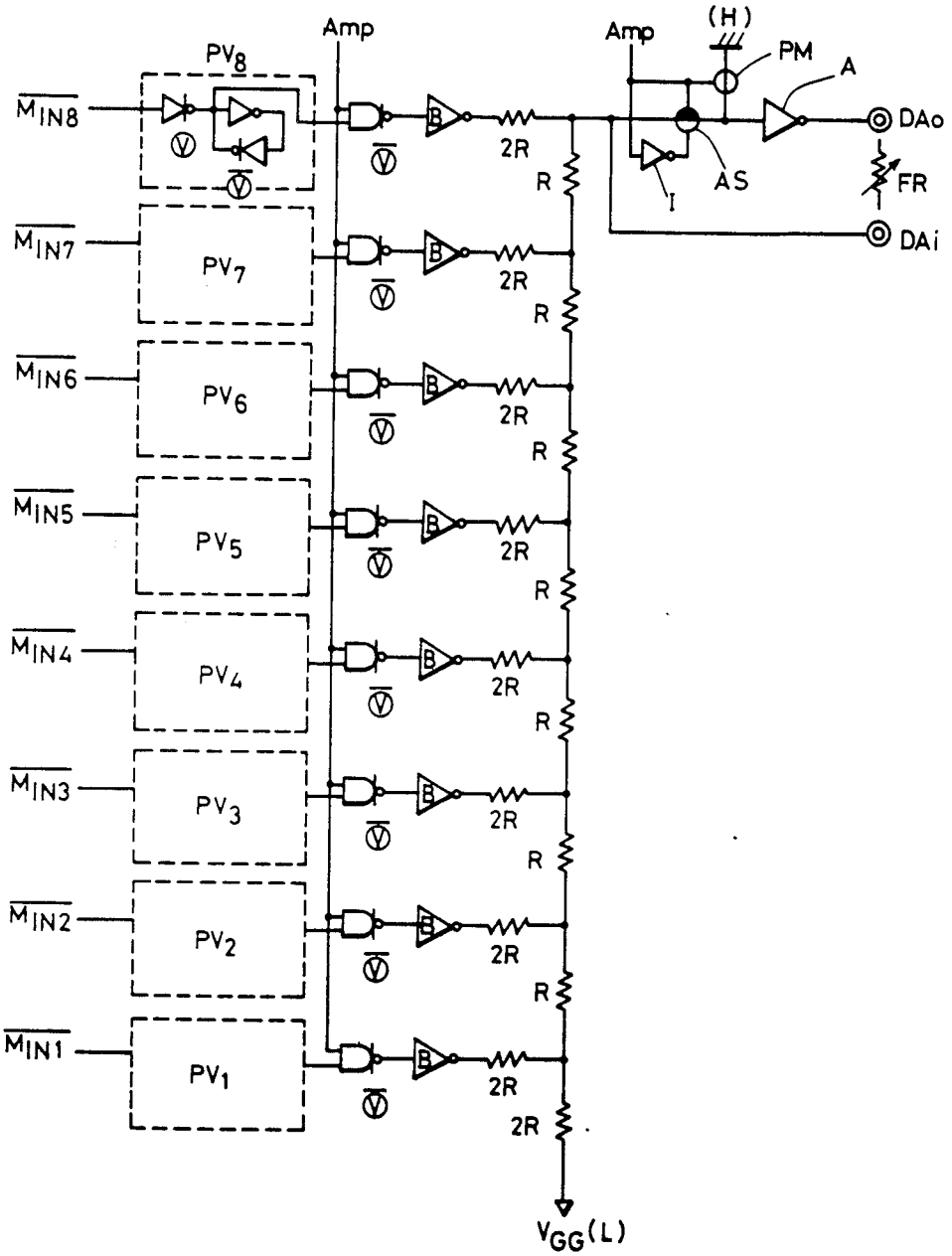
FIG. 6 shows a detailed diagram of circuits including the D/A (digital and analog) converter and impedance conversion circuit.

A still further feature of the preferred embodiment of the present invention is that the speech synthesizer LSI incorporates a D/A converter and an impedance conversion circuit. FIG. 6 shows a part of this construction.

In FIG. 6, PV1 through PV8 represent the digital sound signal latch circuits. Output signals from these circuits are sent to the ladder resistors through gates. In order to achieve an extremely high precision, the ladder resistors are respectively composed of diffused resistors. Output DAi is externally connected to the ladder resistor through terminals of LSi. As a result, a speaker can be driven by merely connecting an ordinary amplifying circuit.

The D/A converter output terminal is provided with an impedance conversion circuit composed of an inverter circuit.

A represents an inversion circuit. However, by connecting a feedback resistor FR between the input and output terminals, this circuit can be used as a linear amplifier.

Figure 7:
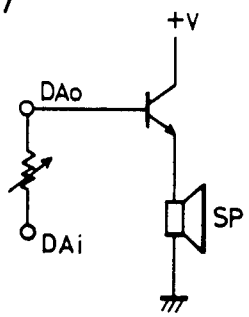
FIG. 7 shows an embodiment of a speaker driver circuit.

Since resistor R in the D/A converter circuit has a resistance value of about 50 or 60K ohms, output impedance of the D/A converter circuit is considerably high. Such a high output impedance is lowered by the impedance conversion circuit provided in the inverter circuit. This allows the current to flow outside, and as a result, a speaker can be driven by a very simple circuit composed of an emitter follower as shown in FIG. 7.

The NAND gate provided in the input of the D/A converter circuit is controlled by a signal Amp. This signal is generated by a logic represented by Amp=F1 $(\overline{ACL+ST})$. F1 represents a signal that turns on the amplifier power source (port 1 also outputs signal F1). ACL represents a signal indicating the auto-clear condition, while ST represents a signal indicating that the display mode still remains.

If the speech synthesizer unit remains in the speech output mode while in the arithmetic operation mode leaving the auto-clear mode, the NAND gate functions as the clock gate, while the digital contents of the latch PVi circuit are converted into analog data. In other words, the NAND gate output remains high and, therefore, the input to the D/A converter circuit becomes low, thus inhibiting the current flow through the ladder resistor, and preventing the power dissipation.

The impedance conversion circuit is also controlled by the Amp signal. Inverter I, analog switch AS, and MOS gate PM make up a control circuit. If the Amp signal is absent, since the output from the inverter becomes high when the input is low, the current flows through the feedback resistor FR, thus causing the power to be dissipated when the speech is not being outputted.

The preferred embodiment of the present invention provides a control circuit that controls the input of the D/A converter circuit as shown in FIG. 6, and as a result, unwanted power dissipation can be prevented. In other words, when the Amp signal is low, the analog switch AS turns off and the input to the inverter circuit A becomes high. Then, DAo becomes low, inhibiting the current to flow through the feedback resistor FR.

When a circuit shown in FIG. 7 is connected, the transistor turns off so that unwanted current will not flow to the speaker.

As a result, the preferred embodiment of the present invention enables the speech synthesizer system to effectively implement the fundamental control of the speech synthesizing, key input and display operations within the one-chip LSI.

Using this technique, for example, when composing a speech electronic calculator, such fundamental controls can effectively be executed by externally connecting the programs related to the arithmetic operation procedures used to implement an electronic calculator and the memory memorizing sound data available for an electronic calculator.

Consequently, such a speech synthesizer LSI, as an extremely versatile apparatus, can be effectively applied to a wide variety of speech synthesizer apparatuses.

What is claimed is:

1. An electronic apparatus for performing a synthesized sound generating function and a diverse processing function comprising;

a single chip integrated circuit including, input control means for controlling input data developed externally of said single chip integrated circuit, calculation control means, operatively connected to said input control means for handling said input data and for performing said diverse processing function and said synthesized sound generating function, internal read only memory means for storing and providing to said calculation control means a synthesis control program for controlling said synthesized sound generating function, and random access memory means for storing and providing to said calculation control means data used by said calculation control means in performing said diverse processing function and said synthesized sound generation function; and external read only memory means, operatively connected to said calculation control means, for storing a diverse processing application program for controlling said diverse processing function of said calculation control means and sound data used by said calculation control means to synthesize desired sounds.

2. The electronic apparatus of claim 1 wherein said diverse processing function is an external device control function.

3. The electronic apparatus of claim 1 wherein said diverse processing function is an arithmetic calculation function.

4. The electronic apparatus of claim 2 wherein said external device control function is control of an information display.

5. The electronic apparatus of claim 2 wherein said external device control function is control of key input information from a keyboard.

6. The apparatus of claim 6 wherein the length of the words stored in said internal read only memory means is longer than the words stored in said external read only memory means;

said single chip integrated circuit further comprising address means for addressing said internal read only memory means and said external read only memory means, at least some words of each said memory means being accessed using identical addresses.

7. The apparatus of claim 6 wherein said single chip integrated circuit further comprises address decoder means for distinguishing between words of said internal read only memory means and external read only memory means having identical addresses by their different lengths.

8. The apparatus of claim 6 wherein said synthesis control program requires a fast processing speed.

9. The apparatus of claim 6 wherein the words defining said synthesis control program stored in said internal read only memory means are formed of a plurality of bits, some of said plurality of bits defining an operation code while the reamining ones of said plurality of bits defining are operand code.

10. The apparatus of claim 6 wherein said single integrated circuit chip further comprises:

D/A converter means including, a ladder resistor network for converting digital sound data provided by said calculation control means into a plurality of analog voltage levels, gate circuit means connected to said ladder resistor network for converting said analog voltage levels into a synthesized analog sound signal.

11. The apparatus of claim 10 wherein said single chip integrated circuit further comprises:

main program counter means, responsive to control by said calculation control means, for addressing locations in said external and internal read only memory means containing said diverse processing application program and said synthesis control program, respectively, to provide said programs to said calculation control means; and data counter means, responsive to control by said calculation control means, for addressing locations in said external and internal read only memory means containing said sound data to provide said sound data to said calculation control means.

12. A single chip integrated circuit for performing a synthesized sound generating function and a diverse processing function and communicating with an external read only memory means comprising:

input control means for controlling input data developed externally of said single chip integrated circuit;

calculation control means, operatively connected to said input control means for handling said input data and for performing said diverse processing function and said synthesized sound generating function;

internal read only memory means for storing and providing to said calculation control means a synthesis control program for controlling said synthesized sound generating function desired sounds;

random access memory means for storing and providing to said calculation control means data used by said calculation control means in performing said diverse processing function and said synthesized sound generation function; and means, adapted to be coupled to the external read only memory means, for reading a diverse primary function application program stored in said external read only memory means and sound data stored in said external read only memory and used by said calculator control means to synthesize desired sounds.

13. The circuit of claim 12 wherein said diverse processing function is an external device control function.

14. The circuit of claim 12 wherein said diverse processing function is an arithmetic calculation function.

15. The circuit of claim 13 wherein said external device control function is control of an information display.

16. The circuit of claim 13 wherein said external device control function is control of key input information from a keyboard.

17. The circuit of claim 12 wherein the length of the words stored in said internal read only memory means is longer than the words stored in the external read only memory means;

said single chip integrated circuit further comprising address means for addressing said internal read only memory means and said external read only memory means, at least some words of each said memory means being accessed using identical addresses.

18. The apparatus of claim 17 wherein said single integrated circuit chip further comprises:

D/A converter means including, a ladder resistor network for converting digital sound data provided by said calculation control meeans into a plurality of analog voltage levels, gate circuit means connected to said ladder resistor network for converting said analog voltage levels into a synthesized analog sound signal.

19. The apparatus of claim 18 wherein said single integrated circuit chip further comprises:

main program counter means, responsive to control by said calculation control means; for addressing locations in said external and internal read only memory means containing said diverse processing application program and said synthesis control program, respectively, to provide said programs to said calculation control means; and data counter means, responsive to control by said calculation control means, for addressing locations in said external and internal read only memory means containing said sound data to provide said sound data to said calculation control means.

* * * * *